US010244806B2

(12) United States Patent
Marks

(10) Patent No.: US 10,244,806 B2
(45) Date of Patent: Apr. 2, 2019

(54) MAGNETIC SNAP FASTENER

(71) Applicant: Alan C Marks, Carmel Valley, CA (US)

(72) Inventor: Alan C Marks, Carmel Valley, CA (US)

( * ) Notice: Subject to any disclaimer, the term of this patent is extended or adjusted under 35 U.S.C. 154(b) by 146 days.

(21) Appl. No.: 14/912,284

(22) PCT Filed: May 28, 2015

(86) PCT No.: PCT/US2015/032867
§ 371 (c)(1),
(2) Date: Feb. 16, 2016

(87) PCT Pub. No.: WO2015/184085
PCT Pub. Date: Dec. 3, 2015

(65) Prior Publication Data

US 2016/0206028 A1 Jul. 21, 2016

Related U.S. Application Data

(60) Provisional application No. 62/004,874, filed on May 29, 2014.

(51) Int. Cl.
*A41F 1/00* (2006.01)
*A44B 17/00* (2006.01)

(52) U.S. Cl.
CPC ..... *A41F 1/002* (2013.01); *A44B 17/0041* (2013.01); *A44D 2201/00* (2013.01); *A44D 2203/00* (2013.01)

(58) Field of Classification Search
CPC . A41F 1/002; A44D 2201/00; A44D 2203/00; A44B 17/0041
See application file for complete search history.

(56) References Cited

U.S. PATENT DOCUMENTS 5,432,986 A * 7/1995 Sexton ..... A44C 5/2071 24/303
5,722,126 A 3/1998 Reiter
(Continued)

FOREIGN PATENT DOCUMENTS

CN 202959066 U 6/2013
JP H11169208 A 6/1999

OTHER PUBLICATIONS

Grieg, Alex; "Wife of Parkinson's sufferer invents magnetic shirt which closes buttons automatically"; Daily Mail Newspaper; Jul. 4, 2013; 3 pps.

*Primary Examiner* — Robert Sandy
*Assistant Examiner* — Louis A Mercado
(74) *Attorney, Agent, or Firm* — Avyno Law P.C.

(57) ABSTRACT

An interlocking magnetic snap fastener of simplified construction for use with garments is provided. The magnet fastener includes two mating magnetically attracting elements of minimal thickness. The first element includes a central opening having a magnet or ferromagnetic disk recessed in the opening, creating recess for engagement with an opposing magnet protruding from the second element. Engagement through the recess prevents lateral movement between, and disengagement of, the first and second elements. The fastener is constructed such that, when placed in close proximity to the recess of the first element, the magnet in the second element is induced to slide sideways, enter the recess of the first element, and assume automatically-aligned contact with its magnetic counterpart.

22 Claims, 5 Drawing Sheets

(56) References Cited

U.S. PATENT DOCUMENTS

| | | | | |
|---|---|---|---|---|
| 5,920,966 | A | 7/1999 | Chen | |
| 5,987,715 | A | 11/1999 | Khon | |
| 6,215,381 | B1 | 4/2001 | Aoki | |
| 6,226,842 | B1 | 5/2001 | Wong | |
| 7,178,207 | B2 | 2/2007 | Wong et al. | |
| 2005/0177985 | A1* | 8/2005 | Sjoquist | A41F 1/002 24/104 |
| 2012/0174346 | A1* | 7/2012 | Fildan | A41F 1/002 24/303 |
| 2014/0143985 | A1 | 5/2014 | Horton | |
| 2014/0259553 | A1 | 9/2014 | Sjoquist | |

* cited by examiner

MAGNETIC SNAP FASTENER

RELATED APPLICATIONS

This application claims priority of U.S. Provisional Patent Application Ser. No. 62/004,874, filed on May 29, 2014, titled MAGNETIC SNAP FASTENER, the application of which is incorporated in its entirety by reference in this application.

BACKGROUND OF THE INVENTION

1. Field of the Invention

This invention relates to simplifications in the construction of magnetic snap fasteners, and more specifically, to an interlocking magnetic fastener for use in garments.

2. Related Art

Overlapping flaps of clothing have traditionally been secured by the use of buttons. There has been much interest shown in developing simplified ways of doing this. The zipper was one of these. Using synthetic materials that stick together with tiny hooks and loops was another approach. Neither of these approaches overcame the difficulties experienced by those with limited manual dexterity, such as people suffering from arthritis, Parkinson's disease, muscular dystrophy, and other diseases. Using a zipper requires fine motor skills Hook and loop connectors, and mechanical snaps require strength and coordination to manipulate. Additionally, hook and loop connectors require hand and eye coordination to avoid misalignment.

Magnetic closures have been employed in purses, belts, and more recently, in clothing and they offer some significant advantages. They offer the potential of quick closure and simplified disengagement between two sheets of flexible material. Two magnets, each attached to one of the two sheets and oriented north pole of one to the south pole of the other, serve for this purpose. Alternatively, a magnet that attracts an opposing piece of ferromagnetic material achieves the same result.

In prior attempts to use magnets, a housing with a recess containing a ring magnet is attracted to either a second, similarly housed magnet or a disk of ferromagnetic material featuring a corresponding protrusion that enters the recess and is integral with the housing (see e.g., U.S. Pat. No. 5,722,126 to Reiter (1998)). The magnets in these fasteners need to be oriented and guided visually to achieve connection.

In order to secure these two magnet components to flexible material (e.g., fabric), several means were used historically, among these, screws, rivets and bendable legs. These means were either attached to or incorporated in the above-mentioned housings. Housings fastened in this way can cause discomfort when sharp edges contact the body, and such housings were not generally attached to woven textiles, which form the bulk of clothing worn. Additionally they were complicated and costly to manufacture, and therefore, mostly used in belts and purses. Such fastening methods are found it prior art U.S. Pat. No. 5,722,126 to Reiter (1998), U.S. Pat. No. 5,987,715 to Kohn (1999), and U.S. Pat. No. 7,178,207 to Wong et al. (2012).

Some of these housings both incorporated ring magnets and featured a central aperture with holes for thread, allowing for these housings to be sewn to material, such as cloth. The several metal pieces used to encase many of these closures required complex machine fabrication and assembly and the resulting closures were heavy. Additionally, the combined thickness of two connected housings occupied a space of some size and a gap resulted. This gap rendered them disadvantageous to use in shirts and pants, where, in addition to presenting an unusual appearance and compromising intimacy, the gap allowed the entry of cold air. See, e.g., U.S. Pat. No. 5,722,126 to Reiter (1998), and U.S. Pat. No. 7,178,207 to Wong et al (2012).

None of the art previously cited could be advantageously retrofitted into existing clothing. Additionally, none is suited for incorporation in conventional, textile-based clothing, which comprises the majority of clothing currently worn.

It has been difficult in past to create a suitably thin housing for fastening clothing magnetically because magnets have been retained by either a thickening of the housings or by partitions that enclose them. This disadvantageous thickening or partition prevents direct contact between two surfaces attracted magnetically, requiring the magnets used to be of larger size to compensate for this lack of direct contact, further increasing the overall size and weight. See, e.g., U.S. Pat. No. 6,215,381 to Aoki (2001) and U.S. Pat. No. 6,226,842 to Wong (2001).

Magnets sewn into opposing textile pockets have been recently introduced in an effort to reduce thickness and unsightly appearance. This particular form of connection carries with it a significant disadvantage. When subjected to lateral forces, slipping and disengagement of the two fabric surfaces occurs because there is no form of positive engagement of the magnets to prevent this from happening. Moreover, because at least two layers of textile separate the two magnets from contact, magnets of size large enough to overcome this separation must be used. Clothing that incorporates fasteners of this type may not be worn by people using pacemakers, another disadvantage. There is reference to such fasteners in non-patent literature, Alex Greig, *Wife of Parkinson's Sufferer Invents Magnetic Shirt Which Closes Buttons Automatically,* Daily Mail.Com (Jul. 4, 2013) as well as in U.S. Patent 2014143985 to Horton.

Thus, a need exists for a new and improved fastener for use in garments that address the problems detailed above.

SUMMARY

The present invention provides interlocking magnetic snap fasteners of simplified construction for use with garments. The magnet fasteners of the present invention comprise two mating magnetically attracted elements of minimal thickness. A central recess in a first element containing a magnet or ferromagnetic disk provides for entry and engagement with an opposing magnet protruding from a second element. Engagement within a recess prevents lateral movement between, and disengagement of the first and second elements. A magnetic force field is generated between the magnets, or alternatively, between the ferromagnetic disk of the first element and the protruding magnet of the second element. The magnet in the second element is induced to slide sideways, enter the recess of the first element, and assume magnetically aligned contact with its counterpart when placed in close proximity to the recess.

The magnetic force in the magnetic fastener of the present invention can be sensed tactilely to guide placement, and positive union of the two elements may be confirmed an audible click or mere engagement. No visual guidance, and minimal manual coordination, is needed to mate the first and second elements of the magnetic fastener of the present invention. The magnetic fastener of the present invention is ideal for people who are handicapped either visually, physically or both. Further, the fasteners require only a light, outward tug on an outermost flap of the garment to which they are secured to remove an article of clothing equipped with them.

As will be illustrated further below, the magnetic fastener of the present invention is easily manipulated, lighter in weight, thinner and more economical to produce than prior art fasteners. No visual or precise physical alignment is required to effect closure and, once closed, the magnetic fasteners are resistant to lateral movement.

The magnetic fasteners are further designed to be attached to textiles using conventional sewing machinery for new clothing or retrofitted to existing closing. Further, the fasteners may be secured behind conventional buttons so that their use is undetectable and does not attract undue attention to the wearer. Since the fasteners may be easily retrofitted to existing clothing with a needle and thread or a sewing machine, users can attach the fasteners to existing clothing, as opposed to discarding the clothing, if, for example, it has become too difficult for the wearer to button conventionally. The invention further uses small magnets that do not affect pacemakers.

Fabrication of the fasteners of the present invention is easy—essentially requiring only two steps, two insertions, that can be accomplished using the same air-operated press, making for low cost of production. Only a small amount of material is required for fabrication, making the fasteners economical to produce. Lastly, the fasteners may be constructed to not be subject to rusting and may be washed traditionally and/or dry cleaned without suffering harmful effects.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Various examples of magnetic fasteners of the present invention are described below in connection with FIGS. 1 & 2 and their subfigures. As will be explained further below, the magnetic fastener 1 of the present invention is constructed of two elements 6, 8. The elements 6, 8 are designed to be of minimal thickness and to attract their counterparts, through projecting and receiving magnets, in a manner that eliminates sliding and accidental disengagement.

Figure 1:
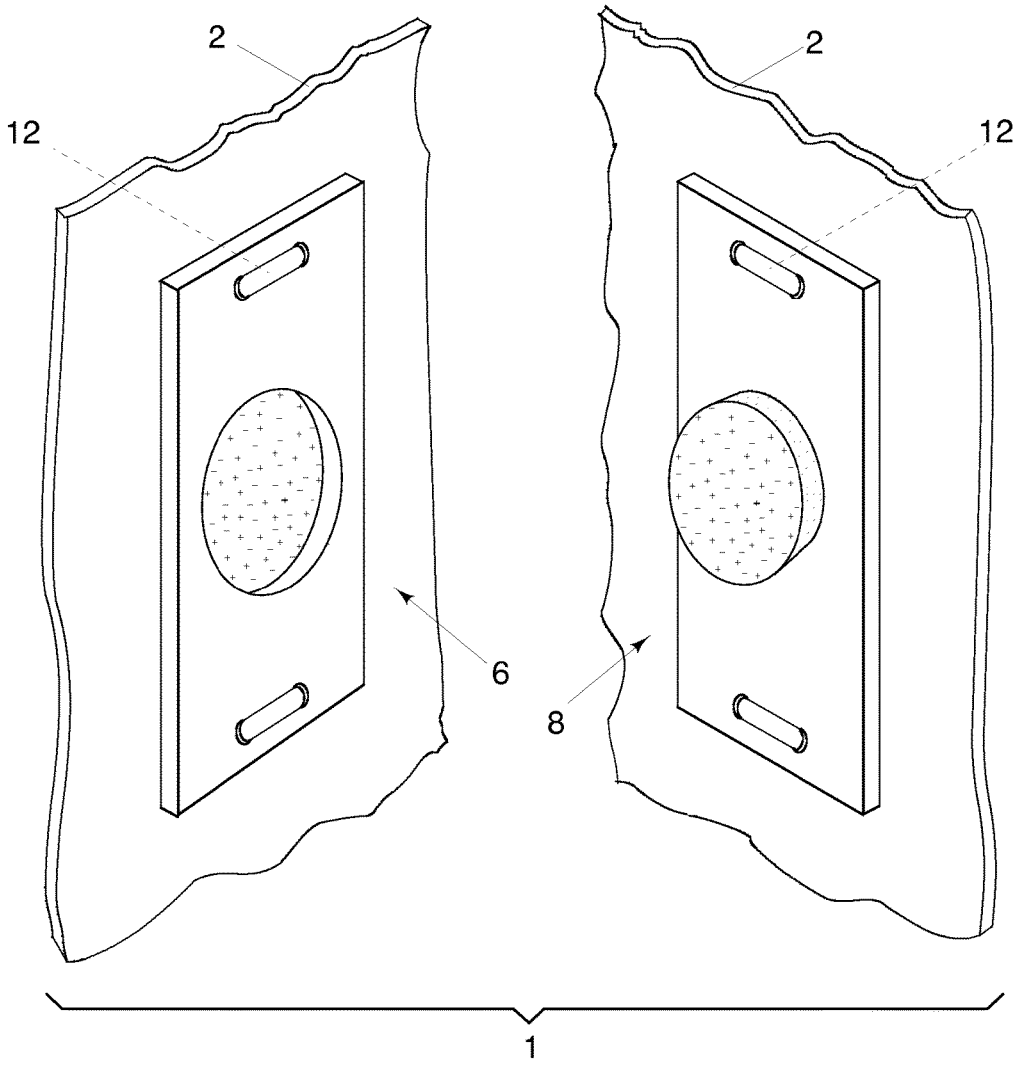
FIG. 1 is a perspective view of one example of two elements of a proposed magnetic fastener of the present invention as sewn to sheet material.

FIG. 1 is a perspective view of one example of two elements 6, 8 of a proposed magnetic fastener 1 of the present invention as sewn to sheet material 2. The two elements, 6, 8 of the magnetic fastener 1 are shown oriented in opposition and fastened each to a piece of sheet material 2 by thread 12. Element 6 is referred to as the receiving element and element 8 is referred to as the insertion element. Both elements 6, 8 include plates 16, 26, made of non-magnetic material, having central openings 24 (FIGS. 1*a* and 1*b*) for receiving magnetic disks 22, 28 of opposing poles. In the receiving element 6, the magnetic disk 22 is positioned into the central opening 24 in a recessed manner. In the insertion element 8, the magnetic disk 28 is positioned in the central opening 24 such that a portion of the magnetic disk 28 protrudes outward past the front face of the plate 26. Holes 20 in the plates 16, 26 permit the securing of the plates 16, 26 to material 2 using, for example, thread 12.

Figure 1A:
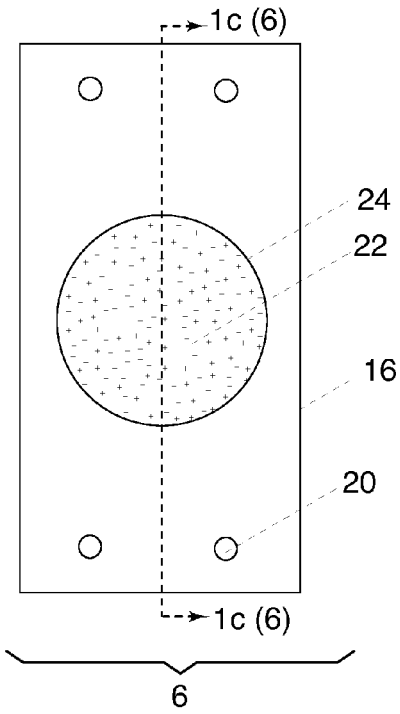
FIG. 1*a* is a plan view of the receiving element of the magnetic fastener of FIG. 1.
Figure 1B:
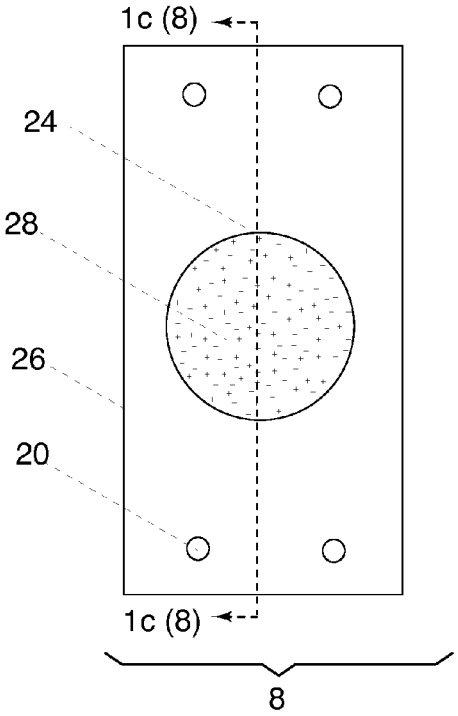
FIG. 1*b* is a plan view of the insertion element of the magnetic fastener of FIG. 1.

These two elements 6,8 are elaborated upon in detail in FIG. 1*a*, 1*b*, 1*c*, 1*d* and 1*e*. FIGS. 1*a* and 1*b* show the two elements, 6 and 8 of FIG. 1 in plan view. FIG. 1*a* is a plan view of the receiving element 6 of the magnetic fastener 1 of FIG. 1. FIG. 1*b* is a plan view of the insertion element 8 of the magnetic fastener 1 of FIG. 1.

As illustrated in FIG. 1*a*, receiving element 6 is comprised of plate 16 having a central opening 24. The central opening 24 being slightly greater than the diameter of the magnet 28 (FIG. 1*b*) that protrudes from the insertion element 8, as will be described in further detail below. A neodymium, disk-shaped magnet 22 is recessed into the opening 24. The thickness of the disk-shaped magnet 22 is less than that of the depth of the central opening 24, creating a recess 18 in the plate 16 for receiving the magnet 28 of the insertion element 8. The size of the opening 24 would then be sized to be slightly larger than the diameter of the magnet 28 to permit the magnet 28 to enter and be retained within the opening 24.

In one example, the diameter of the magnet 22 recessed into opening 24 may be approximately 0.8 mm (1/32") greater than that of magnet 28 (FIG. 1*b*) of the insertion element 8 and have a thickness of approximately 0.8 mm. (1/32"). Plate 16 of receiving element 6 and plate 26 of insertion element 8 may be formed of thermoplastic material, e.g., copolyester. In this example, plates 16 and 26 may be approximately 1.6 mm (1/16") thick. In this manner, when magnet 22 is inserted into the central opening 24 with the back face of the magnet 22 flush with the back face of the plate 16, a 0.8 mm (1/32")

recess 18 is created in the central opening 24 for receiving the magnet 28 of insertion element 8.

Neodymium may be used for the magnet 22 because of the superior force of attraction it exerts for its size. Optionally, a disk 1.3 mm (3/64") in thickness, consisting of terrific stainless steel of type 430FR or 430F, could be substituted for the planar disk magnet 22 of the receiving element 6. Martensitic stainless steel could also be used but would not result in as strong of a bond. Those skilled in the art will recognize the size of the magnetic fastener 1 may vary depending upon application and accordingly, the size of the magnet 22 and recessed opening 24 may also vary. The above dimensions are offered for illustration only and represent only one example of an implementation of the invention.

The planar disk magnet 22 or, alternatively, the ferromagnetic disk, may be secured into the central opening 24 of plate 16 by an interference fit, otherwise known as a press fit. Those skilled in the art will, however, recognize that other means of affixing the magnet 22 in the central opening 24 are possible, including, but not limited to molding it into the thermoplastic material or by using an adhesive. One of the parallel surfaces of magnet 22 is coplanar with one surface of plate 16. Plates 16, 26 may be of any shape, however a substantially rectangular shape, providing two holes at each end, is easily attached using conventional sewing machinery and thread 12.

As illustrated in FIG. 1*b*, the insertion element 8 is comprised of a plate 26, which may be formed of thermoplastic material similar to that mentioned previously. The plate 26 has a central opening 24 and a neodymium disk magnet 28 of grade N42 or stronger. In this example, the disk magnet 28 may be 4.8 mm (3/16') in diameter and 2.4 mm (3/32") thick. Other diameters and thicknesses are possible as well. As stated above, those skilled in the art will recognize the size of the magnetic fastener 1 may vary depending upon application and accordingly, the size of the magnet 28 and recessed opening 24 may also vary. The above dimensions are offered for illustration only and represent only one example of an implementation of the invention.

Similar to magnet 22, the disk magnet 28 may be secured in the central opening 24 of insertion element 8 by an interference fit, otherwise known as a press fit. Those skilled in the art will, however, recognize that other means of affixing the magnet 28 in the central opening 24 are possible, including, but not limited to molding it into the thermoplastic material or by using an adhesive. Optionally, the plate 26 may be planar, absent the central opening 24 and the magnet 28 may be adhered directly to the front face of the planar plate 26.

In the illustrated example, magnet 28 is inserted into the central opening 24 of plate 26. When inserted, one of the two parallel surfaces of the neodymium magnet 28 is coplanar with one surface of plate 26 such that the magnet 28 is flush with one surface of the plate 26 and protrudes outward beyond the other surface of the plate 26. Based upon the above dimensions, in this example, the magnet 28 will extend outward, past the front surface of the plate 26 approximately 0.8 mm (1/32").

To secure the plates 16, 26 to material, plates 16, 26 may contain four holes 20, which perforate the plates, providing passage for thread 12. The plates 16, 26 may be of any shape, however, including but not limited to the rectangular shape shown and illustrated in connection with FIG. 1 and its subfigures. Further, as previously stated, the diameter of magnet 28 is dimensioned at minimum 0.8 mm (1/32") less than the inner diameter of central opening 24 to enable it to enter and engage with magnet 22 of the receiving element. In this example, since magnet 28 is 4.8 mm (3/16") in diameter, magnet 24 would be approximately 5.5 mm (7/32") in diameter.

Figure 1C:
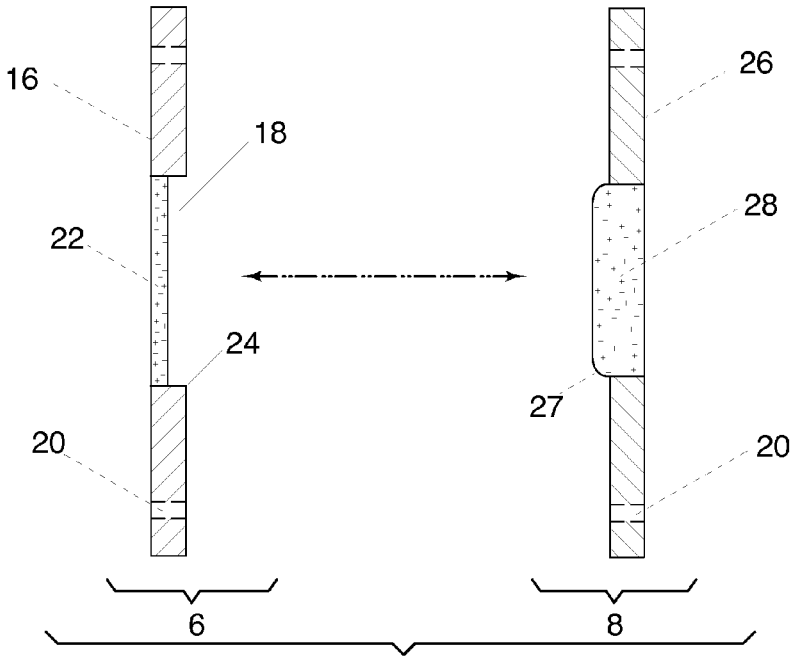
FIG. 1*c* is a cross-section of the receiving element taken along line 1*c*-1*c* (6) of FIG. 1*a* and the insertion element taken along line 1*c*-1*c* (8) of FIG. 1*b* aligned in opposition for engagement purposes.

FIG. 1*c* is a cross-section of the receiving element 6 taken along line 1*c*-1*c* (6) of FIG. 1*a* and the insertion element 8 taken along line 1*c*-1*c* (8) of FIG. 1*b* aligned in opposition. FIG. 1*e* is a cross-section of the receiving and insertion elements of FIG. 1*c* in engagement with one another. In FIG 1*c* and 1*b*, receiving element 6 and the insertion element 8 are oriented in a position of potential engagement or disengagement as indicated by the bi-directional arrow between the two. As illustrated, when engaged, the protruding portion 27 of magnet 28 enters recess 18 and makes direct contact with the face of magnet 22 of receiving element 6, as illustrated in FIG. 1*e*.

Figure 1D:
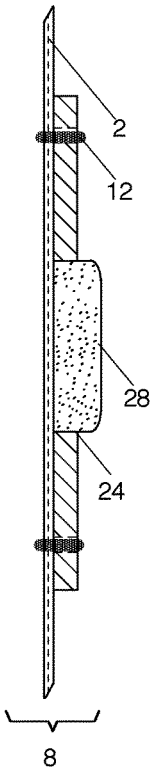
FIG. 1*d* is a cross-section view the insertion element of the fastener of FIG. 1 illustrating the manner in which the insertion element is sewn by thread to a sheet material.
Figure 1E:
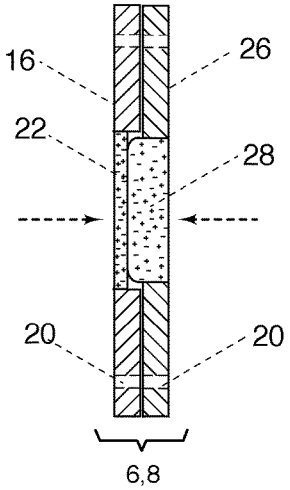
FIG. 1*e* is a cross-section of the receiving and insertion elements of FIG. 1*c* in engagement with one another.

FIG. 1*d* is a cross-section view of the insertion element of the fastener of FIG. 1 illustrating the manner in which the insertion element is sewn by thread to a sheet material. FIG. 1*d* shows, in sectional view, element 8 of FIG. 1*a*, illustrating how it attaches with thread 12 to sheet material 2.

As set forth above, neodymium magnets may be used in connection with magnets 22, 24. While other magnets may be used, neodymium magnets are produced and protected from oxidation through nickel plating, epoxy coating or a combination of both. Other non-organic coatings may be used as well. Thermoplastic plates 1.6 mm (1/16") thick appear to work well with most materials; however, thicker materials may require thicker and larger magnetic fasteners 1 and thinner materials may be better suited for smaller magnetic fasteners 1. Outer dimensions may vary depending upon application. One acceptable size for the outer dimensions of the receiving element 6 and insertion element 8 is 8 mm (3/8")×16 mm (5/8"). Both elements 6 and 8 may be sized to be the same and may be either precision stamped or formed through injection molding.

In operation, when insertion element 8 comes anywhere in close proximity to receiving element 6, the magnet 28 slides into automatic alignment with the magnet 22 within recess 18 and is drawn into full contact with the surface of the magnet 22 due to the powerful force field attracting the two neodymium magnets and urging them to connect centered on the magnetic axis they share in common.

Figure 2:
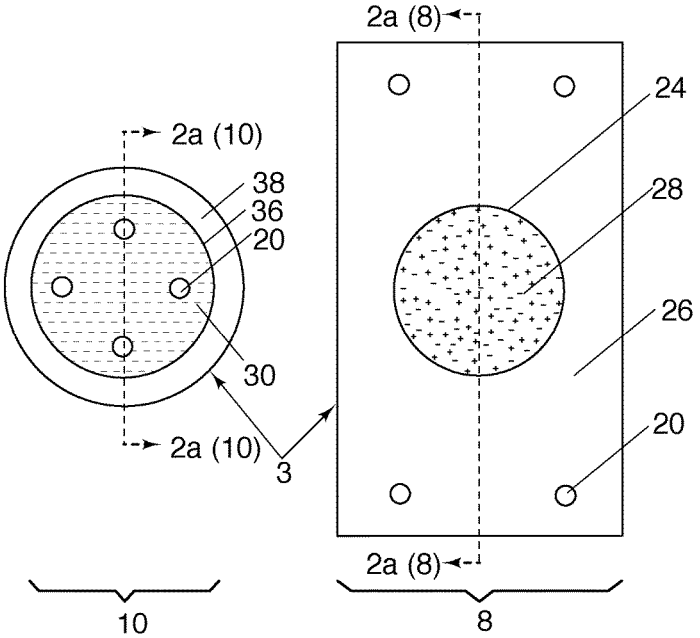
FIG. 2 is a plan view of another example of two elements that form of a magnetic fastener in accordance with the present invention.

FIG. 2 is a plan view of another example of two elements 8, 10 that form a magnetic fastener 3 in accordance with the present invention. In this example, the receiving element 10 consists of a ring of thermoplastic material 38 having a central opening 36. In its opening 36 is recessed and affixed by means of an interference fit, also known as a press fit, a ferromagnetic disk 30, which is perforated by four holes 20 to enable it to be fastened to sheet material 2 using thread 12 (FIG. 1). The insertion element 8 is generally similar in construction to, if not identical to, the insertion element 8 of FIG. 1, and comprising a plate 26 have a central opening 24 into which is pressed a disk magnet 28. The material of insertion element 8 may also be similar to those of insertion element 8 (FIG. 1). Similar to as illustrated in FIG. 1, plate 26 is perforated by a four holes 20 to allow it to be fastened with thread 12 to sheet material.

Figure 2A:
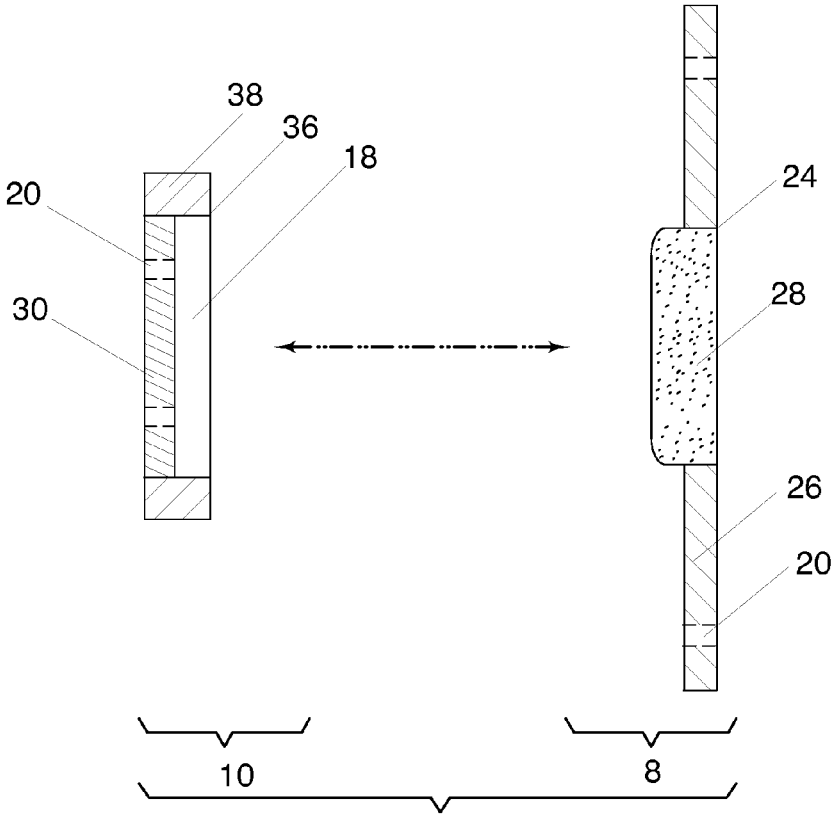
FIG. 2*a* is a cross-section view of the receiving element taken along line 2*a* (10) of FIG. 2 and the insertion element taken along line 2*a* (8) of FIG. 2.

FIG. 2*a* is a cross-section view of the receiving element 10 taken along line 2*a* (10) of FIG. 2 and the insertion element 8 taken along line 2*a* (8) of FIG. 2. Insertion element 8 is illustrated opposed to receiving element 10 oriented in a position of potential engagement or disengagement, indicated by the bidirectional arrow between the two. Receiving element 10 is comprised of circular ring 38, formed of thermoplastic material, e.g., copolyester, and ferromagnetic disk 30 affixed in the recess 18 within opening 36. This ferromagnetic disk 30 may be secured into the circular ring 38 by an interference fit, otherwise known as a press fit, Those skilled in the art will, however, recognize that other means of affixing the ferromagnetic disk (i.e., magnet) 30 are also possible, including, but not limited to molding it into the thermoplastic material or by using an adhesive. When positioned in the ring 38, one of the parallel surfaces of ferromagnetic disk 30 is coplanar with one of the two parallel surfaces of ring 38. A plurality of holes 20 perforates disk 30. Ferromagnetic disk 30 may be made of the same or similar materials to the magnets 24, 28 in the example of 1.

As noted above, the insertion element 8 of FIG. 2*a* is comprised of plate 26 having a central opening 24 and a neodymium disk magnet 28. In one example, the disk magnet 28 is 4.8 mm (3/16") diameter, 2.4 mm (3/32") thickness, and grade N42 or stronger. Other diameters and thicknesses are possible as well. This planar disk magnet 28 may be secured in the body of element 8 by an interference fit, otherwise known as a press fit, using an arbor press or a pneumatic press. Other methods for affixing the disk 28 are also possible, as described in connection with the insertion element 8 in FIG. 1. When inserted into the central opening 24, one of the two parallel surfaces of neodymium magnet 28 is coplanar with one surface of plate 26. Plate 26 may contain a plurality of holes 20, which perforates it, providing passage for thread. As discussed previously, the plate may be of any shape. Further, the diameter of magnet 28 is dimensioned at minimum 0.8 mm (1/32") less than the inner diameter of central opening 36 to facilitate engagement.

Figure 2B:
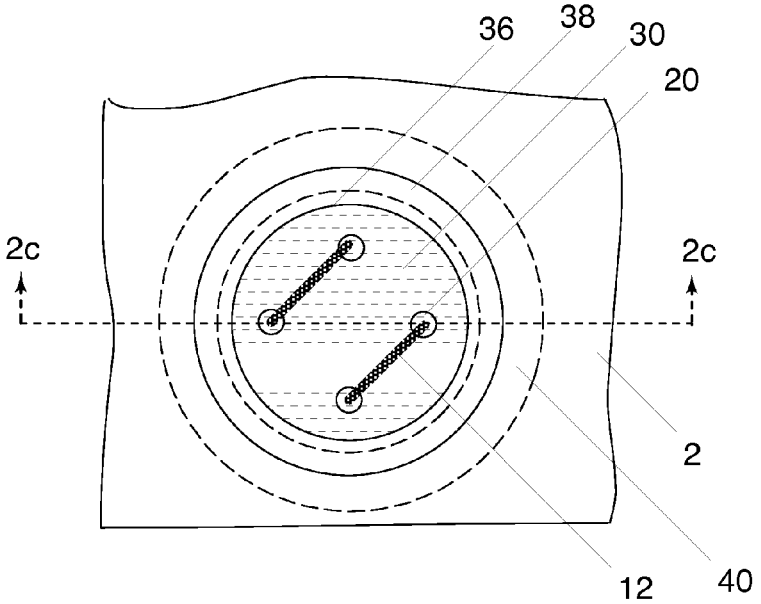
FIG. 2*b* is a plan view of the receiving element of FIG. 2 illustrating it fastened by thread to a piece of sheet material and to a conventional button.

FIG. 2*b* is a plan view of the receiving element 10 of FIG. 2 illustrating it fastened to a piece of sheet material 2 by thread 12. FIG. 2*b* illustrates the receiving element 10 in plan view as connected by thread 12 through holes 20 to a conventional button 40, hidden but indicated by two circles comprised of broken lines, through a piece of sheet material 2. FIG. 2*b* illustrates the circular ring 38, the ring opening 36 and ferromagnetic disk 30.

Figure 2C:
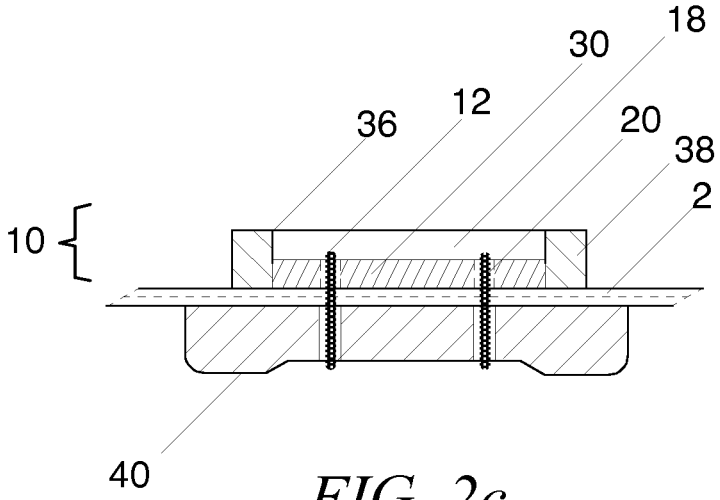
FIG. 2*c* is a cross-sectional of the receiving element of FIG. 2 as illustrated fastened with thread through an intermediary piece of sheet material to a conventional button.

FIG. 2*c* shows a sectional view of receiving element 10 as shown in FIG. 2*b*, which is secured b thread 12, which passes through holes 20 in receiving element 10 and through holes in a conventional button 40, securing the two to sheet material 2 and to each other. The ring opening 36 is indicated as well as recess 18 and the circular ring 38. Optionally, although not shown, the openings 20 may also be positioned around the ring 38, rather than in the magnet or disk 38.

Dimensionally, disk 30 and magnet 28 may be the same as those illustrated and described in connection with FIG. 1 and its subparts. The central openings 36, 24 may further be dimensioned in accordance with the openings 24 of elements 6 and 8 respectively of FIG. 1 and the thickness of elements 10 and 8 may be the same as those of elements 6 and 8 of FIG. 1.

In operation, when insertion element 8 is placed anywhere in close proximity to receiving element 10, its magnet 28 slides into automatic alignment within recess 18 and is induced into full contact with ferromagnetic disk 30 due to the powerful force field attracting the neodymium magnet to the disk and urging the two to center on each other and to connect.

In all examples, a central opening in a first element having a magnet provides for entry and engagement with an opposing magnet in a second element. Engagement through the recess prevents lateral movement between, and disengagement of, the first and second elements. A magnetic force field is generated between magnets, or alternatively, the ferromagnetic disk of a receiving element and the magnet of an insertion element. The magnet is induced to slide sideways, enter the recess of the first element, and automatically assume aligned contact with its counterpart when placed in close proximity to the recess. The magnetic force can be sensed tactilely to guide placement, and positive union of the two elements may be confirmed an audible click or mere engagement. No visual guidance, and minimal manual coordination, is needed to mate the first and second elements of the magnetic fastener of the present invention. The magnetic fastener of the present invention is ideal for people who are handicapped either visually, physically or both.

As illustrated above, the magnetic fasteners are designed to be of minimal thickness and designed to attract their counterparts, through projecting magnets, in a manner that eliminates sliding and accidental disengagement. Utilizing the magnet itself to combine these two functions eliminates having a separate engaging element and decreases thickness and complexity of construction. The magnetic elements of this closure are held gripped in holes perforated in thin, non-ferromagnetic plates that do not in any way contribute to the overall thickness, which in total equals the combined thickness of the two magnetic elements, or approximately 3.2 mm (1/8"). This creates a gap of the same size between the flaps of clothing connected by the fastener and the elements remain hidden and undetectable when engaged. The fasteners construction enables the two magnetic elements to directly contact with each other, thereby maximizing the coercive force and permitting the use of tiny magnets. The small size of the magnets needed and the simplicity of construction make possible an inexpensive closure of minimal weight and thickness.

Although the present magnetic snap fastener is described by reference to particular examples thereof, many changes and modifications of the invention may become apparent o those skilled in the art without departing from the spirit and scope of the invention, which are only limited by the appended claims and their legal equivalents, not by the examples given. To illustrate this, the shape of the plates may different from that depicted in the examples, magnets employing materials other than neodymium may be used, and a ferromagnetic disk may be optionally substituted for the neodymium magnet contained by the receiving element. The plates may be made of non-magnetic materials and of sizes and shapes other than those indicated and additionally may be adhered to sheet material using adhesive, or other fastening mechanisms, instead of using thread through holes. Features described herein in conjunction with a particular aspect or example of the fasteners are understood to be applicable to any other aspect or example. Thus, the examples shown and described are only illustrative, not restrictive.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A magnetic fastener for securing two pieces of sheet material together, the magnetic fastener comprising:

a receiving element for affixing to a first sheet of material, the receiving element having a front face, a rear face and a central opening extending through the receiving element, the receiving element further including a first planar magnet having a front surface and rear surface recessed within the central opening of the receiving element such that the rear surface of the first planar magnet is coplanar with the rear face of the receiving element and where a recess is created in the central opening on the front face of the receiving element;

an insertion element for affixing to a second sheet of material, the insertion element having a front face, a rear face and a second central opening extending through the insertion element, the insertion element having a second planar magnet oriented in opposite polarity to that of the first planar magnet inserted into the second central opening of the insertion element and protruding from the front face of the insertion element, where the second planar magnet has a front surface and back surface and where the back surface of the second planar magnet is coplanar with the rear face of the insertion element, and where the second planar magnet is sized to fit within the recess in the central opening on the front face of the receiving element, such that when the second planar magnet is in proximity to the recess in the central opening of the receiving element, the second planar magnet of the insertion element is induced to enter and substantially fill the recess of the receiving element, securing the two elements together through a magnetic attraction between the first planar magnet and the second planar magnet, where the receiving element and the insertion element include areas surrounding the first planar magnet and the second planar magnet that are nonmagnetic and where a nonmagnetic area of the insertion element is perforated by a plurality of peripheral holes sized to permit a passage of thread for a purpose of affixing the insertion element to the second sheet of material; and where the recess in the receiving element is substantially a same depth as a distance that the second planar magnet protrudes from the front face of the insertion element, where the front face of the receiving element and the front face of the insertion element are brought into direct contact with one another, creating closure of the first and second sheets of material.

2. The magnetic fastener of claim 1 where the second planar magnet of the insertion element is disk-shaped.

3. The magnetic fastener of claim 1, wherein at least one of the planar magnets of the receiving element or the insertion element is affixed to the receiving element and/or the insertion element by an adhesive.

4. The magnetic fastener of claim 1, wherein at least one of the planar magnets of the receiving element or the insertion element is affixed to the receiving element and/or the insertion element by a press fit.

5. The magnetic fastener of claim 1, wherein at least one of the planar magnets of the receiving element or the insertion element is affixed to the receiving element and/or the insertion element by embedment.

6. The magnetic fastener of claim 1 where the receiving element is affixed to the first sheet of material and the insertion element is affixed to the second sheet of material and where the first and second sheets of material are opposing edges of a garment that are intended to be secured together when worn by a user.

7. The magnetic fastener of claim 6 where a button is affixed to the first sheet of material on a side of the first sheet of material opposing the receiving element at a position directly opposite the receiving element.

8. The magnetic fastener of claim 6 where a button is affixed to the second sheet of material on a side of the second sheet of material opposing the insertion element at a position directly opposite the insertion element.

9. The magnetic fastener of claim 1 where a nonmagnetic area of the receiving element is perforated by a plurality of peripheral holes sized to permit a passage of thread for a purpose of affixing the receiving element to flexible sheet material.

10. A magnetic fastener for securing a first and second sheets material, the magnetic fastener comprising: (a) a receiving element having a circular ring of nonmagnetic material having a front face, a rear face and a central opening and a ferromagnetic disk having a front surface and a rear surface affixed within the central opening of the circular ring such that the rear surface of the ferromagnetic disk is coplanar with the rear face of the circular ring and where a recess is created in the central opening on the front face of the circular ring; (b) an insertion element having a nonmagnetic plate and having a disk-shaped, axially magnetized magnet affixed to a central portion of the insertion element, where at least a portion of the magnetized magnet is recessed into the nonmagnetic plate for maintaining the magnetized magnet affixed to the insertion element and protruding a predetermined distance from a surface of the insertion element, the magnet of the insertion element having a substantially circular shape and being undersized sufficiently in relationship to a diameter of the recess in the receiving element to allow easy passage of the magnet through the recess in the receiving element, and the receiving element and the insertion element cooperating in such a way that, when the insertion element is in proximity to the receiving element, the magnet of the insertion element is induced to enter and orient its face parallel to a face of the ferromagnetic disk of the receiving element, and, in this position, to substantially fill the recess of the receiving element and to achieve direct contact with its disk, securing closure of the insertion element and the receiving element together.

11. The magnetic fastener of claim 10, wherein the ferromagnetic disk of the receiving element is affixed to the receiving element by a press fit.

12. The magnetic fastener of claim 10, wherein the ferromagnetic disk of the receiving element is affixed to the receiving element by embedment.

13. The magnetic fastener of claim 10, wherein the ferromagnetic disk of the receiving element is affixed to the receiving element by adhesive.

14. The magnetic fastener of claim 10, wherein the magnet of the insertion element is affixed to the insertion element by adhesive.

15. The magnetic fastener of claim 10, where the receiving element further has a plurality of holes sized to permit a passage of thread for a purpose of affixing said receiving element to the first sheet material.

16. The magnetic fastener of claim 10, where the nonmagnetic plate of the insertion element is further perforated by a plurality of peripheral holes positioned adjacent to, and on opposing sides of, the disk-shaped, axially magnetized magnet affixed to the central portion of the insertion element, where the plurality of peripheral holes are sized to permit a passage of thread for a purpose of affixing the insertion element to the second sheet material.

17. A magnetic fastener for securing two pieces of sheet material together, the magnetic fastener comprising:

a receiving element for affixing to a first sheet of material, the receiving element having a front face, a rear face and a central opening extending through the receiving element, the receiving element further including a first planar magnet having a front surface and rear surface recessed within the central opening of the receiving element such that the rear surface of the first planar magnet is coplanar with the rear face of the receiving element and where a recess is created in the central opening on the front face of the receiving element;

an insertion element for affixing to a second sheet of material, the insertion element having a front face, a rear face and a second central opening extending through the insertion element, the insertion element having a second planar magnet oriented in opposite polarity to that of the first planar magnet inserted into the second central opening of the insertion element and protruding from the front face of the insertion element, where the second planar magnet has a front surface and back surface and where the back surface of the second planar magnet is coplanar with the rear face of the insertion element, and where the second planar magnet is sized to fit within the recess in the central opening on the front face of the receiving element, such that when the second planar magnet is in proximity to the recess in the central opening of the receiving element, the second planar magnet of the insertion element is induced to enter and substantially fill the recess of the receiving element, securing the two elements together through a magnetic attraction between the first planar magnet and the second planar magnet, and where the recess in the receiving element is substantially a same depth as a distance that the second planar magnet protrudes from the front face of the insertion element, where the front face of the receiving element and the front face of the insertion element are brought into direct contact with one another, creating closure of the first and second sheets of material.

18. The magnetic fastener of claim 17, where at least one of the receiving and the insertion elements are affixed to the first or the second sheets of material with an adhesive.

19. The magnetic fastener of claim 17, where the receiving element is affixed to the first sheet of material with an adhesive and where the insertion element is affixed to the second sheet of material with an adhesive.

20. The magnetic fastener of claim 17 where the first and second sheets of material are opposing edges of a garment that are intended to be secured together when worn by a user.

21. The magnetic fastener of claim 17 where a button is affixed to the first sheet of material on a side of a the first sheet of material opposing the receiving element at a position directly opposite the receiving element.

22. The magnetic fastener of claim 17 where a button is affixed to the second sheet of material on a side of the second sheet of material opposing the insertion element at a position directly opposite the insertion element.

* * * * *